US010408588B1

(12) United States Patent
Manley et al.

(10) Patent No.: US 10,408,588 B1
(45) Date of Patent: Sep. 10, 2019

(54) OVER PENETRATION INHIBITING AND RETAINING MECHANISM

(71) Applicant: U.S. Government as Represented by the Secretary of the Army, Picatinny Arsenal, Dover, NJ (US)

(72) Inventors: David Chalfant Manley, Hackettstown, NJ (US); Thomas Michael Presutti, Jr., Long Valley, NJ (US); Jeremy McLain, Kenvil, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/849,840

(22) Filed: Dec. 21, 2017

(51) Int. Cl.

| | |
|---|---|
| ***F42B 12/68*** | (2006.01) |
| ***F42B 12/66*** | (2006.01) |
| ***F42B 12/08*** | (2006.01) |
| ***F42B 30/14*** | (2006.01) |
| ***F41H 13/00*** | (2006.01) |
| *F42B 14/06* | (2006.01) |
| *F41F 3/073* | (2006.01) |
| *F41F 3/042* | (2006.01) |

(52) U.S. Cl.
CPC ..... *F42B 12/08* (2013.01); *F42B 12/66* (2013.01); *F42B 12/68* (2013.01); *F42B 30/14* (2013.01); *F41F 3/042* (2013.01); *F41F 3/073* (2013.01); *F41H 13/0006* (2013.01); *F42B 14/062* (2013.01)

(58) Field of Classification Search
CPC ..... F42B 12/68; F42B 30/00; F42B 30/14; F42B 12/08; F42B 12/66; F41H 13/0006; F41H 12/08; F41H 12/66; F41H 12/68; F41H 30/00; F41H 30/14
USPC ..... 102/400, 439, 504
See application file for complete search history.

(56) References Cited

U.S. PATENT DOCUMENTS

| | | | | | |
|---|---|---|---|---|---|
| 538,626 | A * | 4/1895 | Schmitt | F42B 10/14 | 102/400 |
| 1,315,721 | A * | 9/1919 | Hall | F42B 12/68 | 102/400 |
| 1,318,858 | A * | 10/1919 | Frick | F42B 12/34 | 102/400 |
| 1,536,494 | A * | 5/1925 | Henkes | F42B 30/14 | 102/371 |
| 2,265,697 | A * | 12/1941 | Neumann | F42B 10/56 | 102/400 |
| 3,765,335 | A * | 10/1973 | Blair | F42B 10/48 | 102/400 |
| 3,859,598 | A * | 1/1975 | McElwain | E21B 7/26 | 102/400 |
| 7,007,607 | B1 * | 3/2006 | Fong | F42B 12/10 | 102/400 |
| 8,157,679 | B2 * | 4/2012 | Cyr | F42B 12/68 | 473/578 |

(Continued)

*Primary Examiner* — James S Bergin
(74) *Attorney, Agent, or Firm* — Michael C. Sachs

(57) ABSTRACT

A retaining mechanism which may be launched to capture an unmanned aerial vehicle (UAV) or the like. A projectile deploys dampener arms to stop projectile penetration into the target while forward retention arms deploy to prevent a backward removal from the target. The firmly embedded mechanism might feature tracking means or destruction means, or the target may be pulled away by the tether to be evaluated for information.

4 Claims, 11 Drawing Sheets

(56) References Cited

U.S. PATENT DOCUMENTS

| | | | | |
|---|---|---|---|---|
| 8,418,624 | B2 * | 4/2013 | McGarraugh | F42B 12/365<br>102/439 |
| 8,646,388 | B1 * | 2/2014 | Bradbury | F42B 12/34<br>102/400 |
| 9,021,958 | B1 * | 5/2015 | Bradbury | F42B 7/08<br>102/400 |

* cited by examiner

OVER PENETRATION INHIBITING AND RETAINING MECHANISM

U.S. GOVERNMENT INTEREST

The inventions described herein may be made, used, or licensed by or for the U.S. Government for U.S. Government purposes.

BACKGROUND OF INVENTION

The purpose for this invention is to create a device to attach to an unmanned aerial vehicle (UAV) or other target. The mechanism is launched at the target, will penetrate into the target and will remain firmly attached to the target, for the purposes of tracking the target, destroying the target, or pulling the target away for evaluation with a tether. The problem that this invention addresses is how to avoid over penetrating the target, and how to capture the target on both sides securely after impact so that it is not disengaged.

BRIEF SUMMARY OF INVENTION

The projectile of this invention is shown in a 40 mm concept, but the invention could be adapted to other calibers. A projectile according to this invention is housed in a component which helps to serve as a sabot. Upon exiting the barrel the sabot (or sabots) release from the projectile, and a number of rear dampening arms open. When the projectile impacts the target, it begins to penetrate until the rear dampening arms contact the target causing the lightweight body of the projectile to stop. After the rear portion of the projectile is stopped by the dampening arms, the heavy forward section of the projectile continues forward, due to its momentum, until it compresses a spring and hits a hard stop. As the front section travels forward, spring loaded front retention arms, no longer contained by the retaining rim of the body, open up. The retention arms now retain the object on the object's rear facing side. The result is that the projectile is able to attach itself to a target and to retain it on both sides so that it stays permanently with the target.

OBJECTS OF THE INVENTION

Accordingly, it is an object of the present invention to provide a tethered mechanism which may be launched to capture an unmanned aerial vehicle (UAV) or the like.

Another object of the present invention is to provide a projectile which deploys dampener arms to stop projectile penetration into a target while forward retention arms deploy to prevent a backward removal from the target.

It is a further object of the present invention to provide a target capture mechanism which might also feature means to track the target.

It is yet another object of the present invention to provide a target capture mechanism which might also feature means for select destruction of the target.

It is a still further object of the present invention to provide a projectile launched mechanism to capture an unmanned target which target may then be pulled away on a tether to be evaluated for information.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 1:
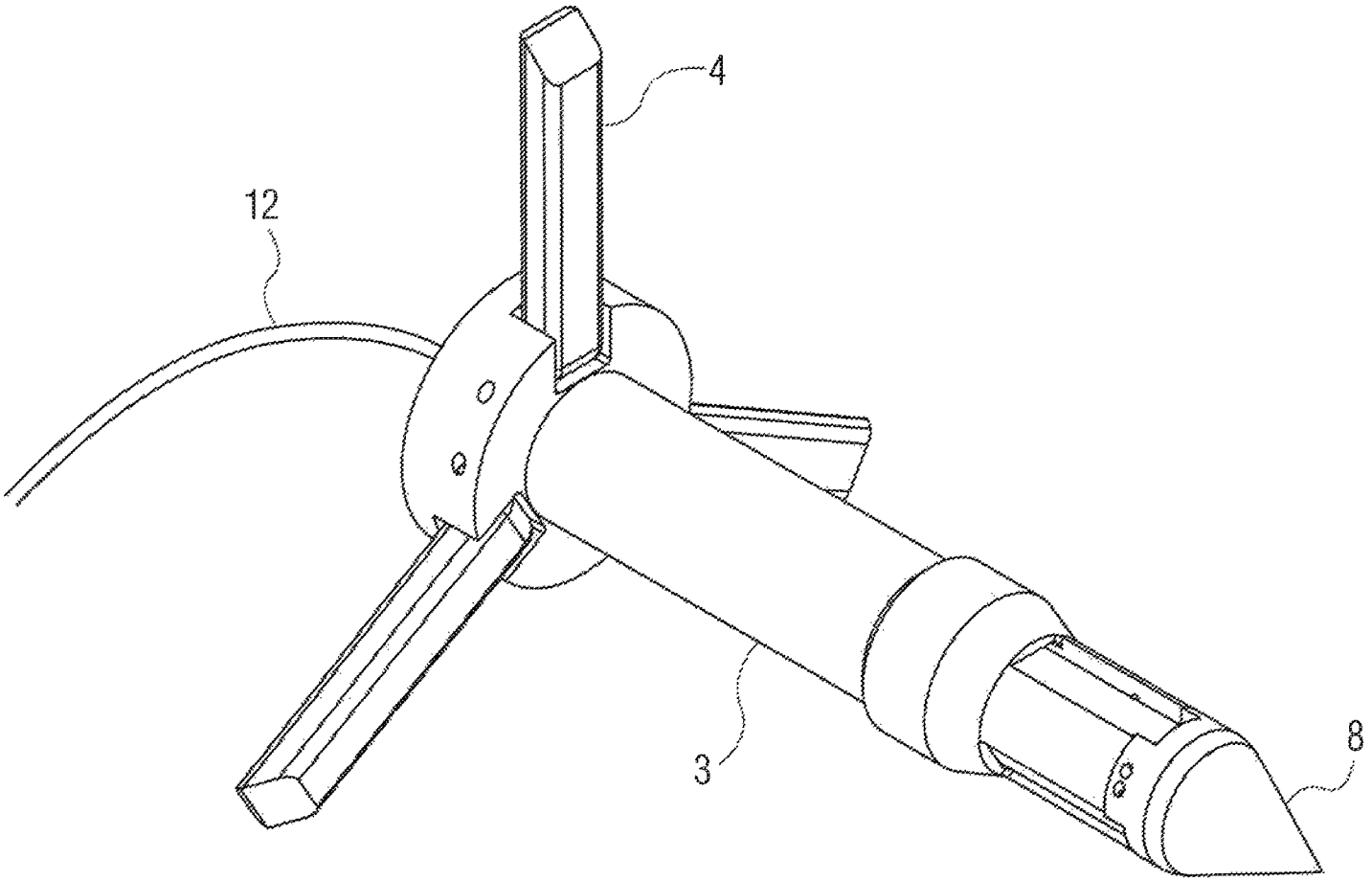
FIG. 1 is a front isometric view of a penetration and retention projectile with deployed dampening arms, according to this invention.
Figure 2:
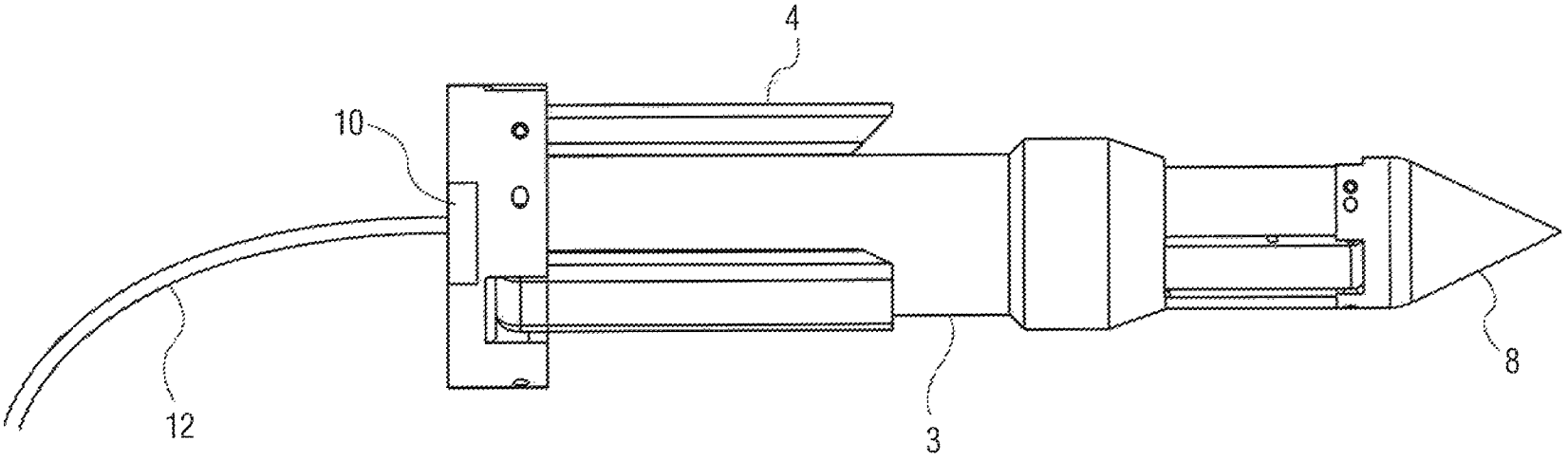
FIG. 2 is a front elevation view of a penetration and retention projectile with folded dampening arms, and an attached tethering line, according to this invention.
Figure 3:
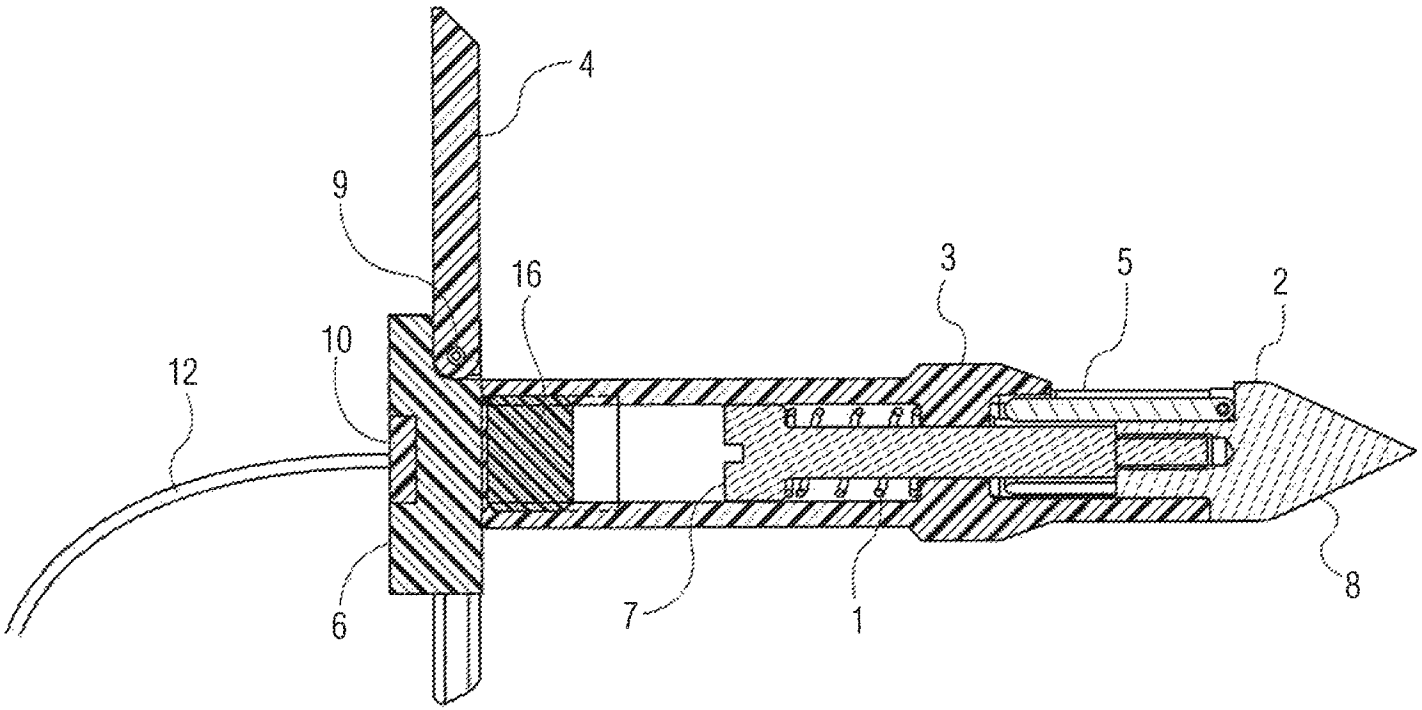
FIG. 3 is a cross sectional view of a penetration and retention projectile with deployed dampening arms and an attached tethering line, according to this invention.
Figure 4:
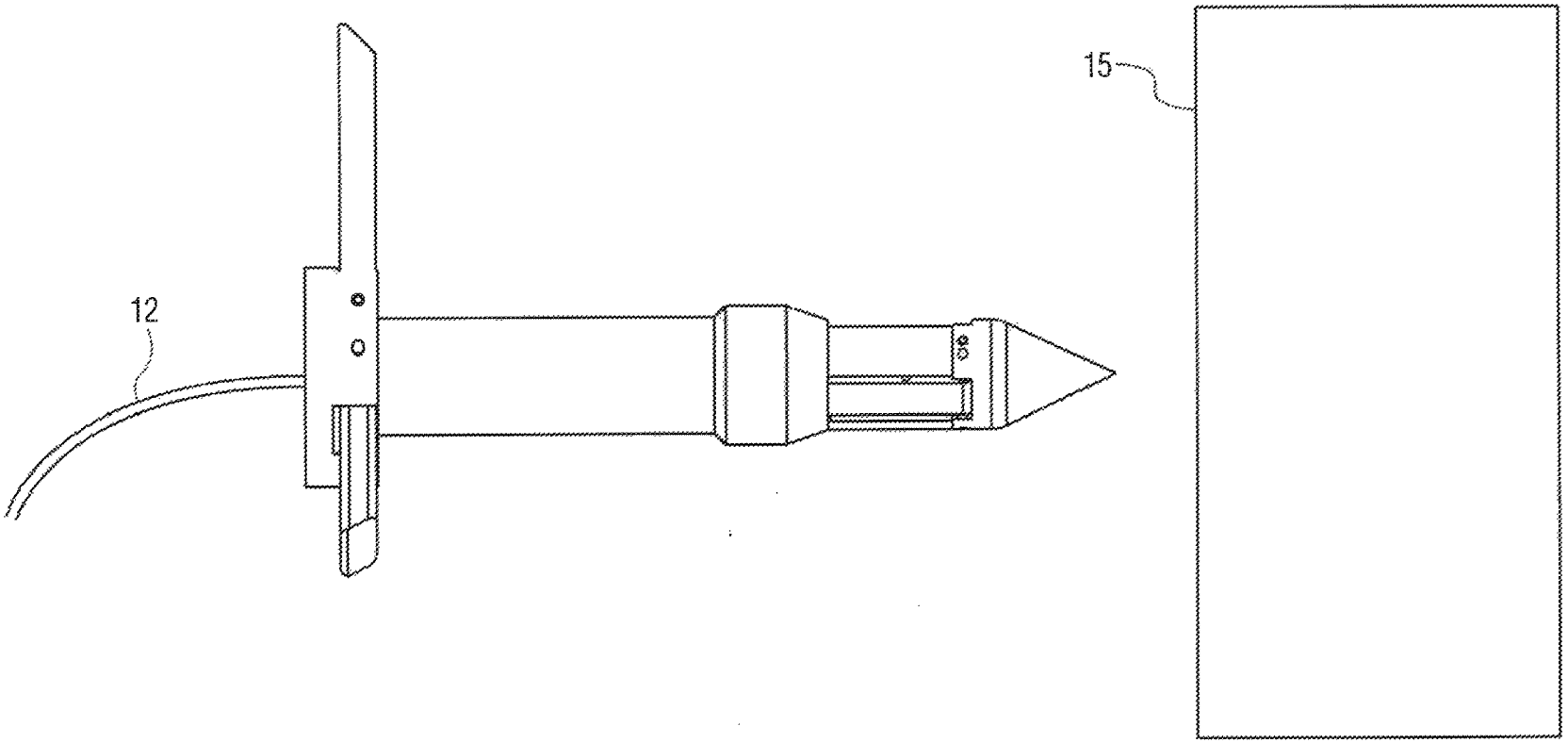
FIG. 4 is a front elevation view of an in-flight penetration and retention projectile with deployed dampening arms and an attached tethering line, and approaching a target 15, according to this invention.
Figure 5:
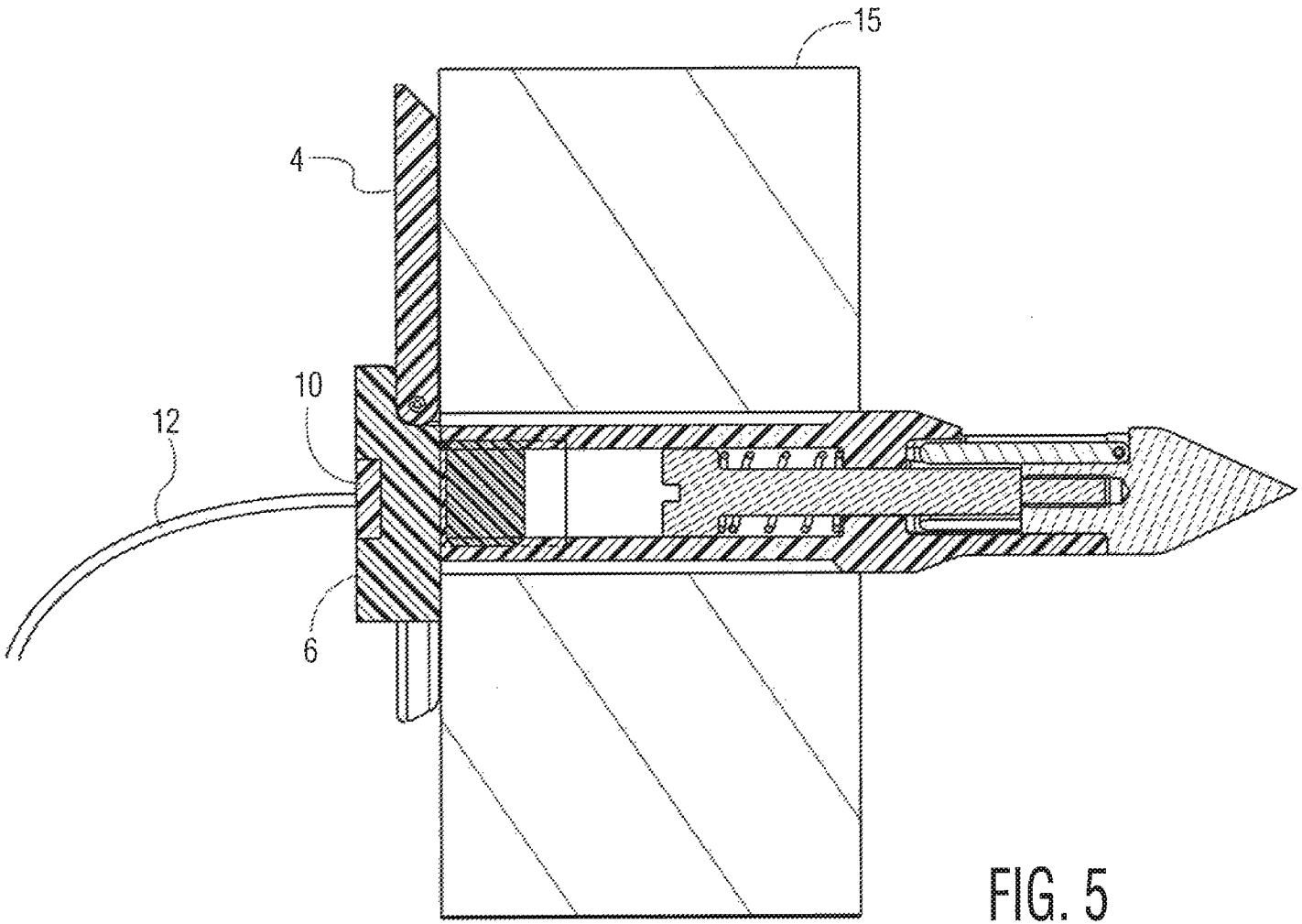
FIG. 5 is a cross sectional view of a penetration and retention projectile with an attached tethering line, after initial penetration of a target 15 stopped as far as permitted by deployed dampening arms 4, according to this invention.
Figure 6:
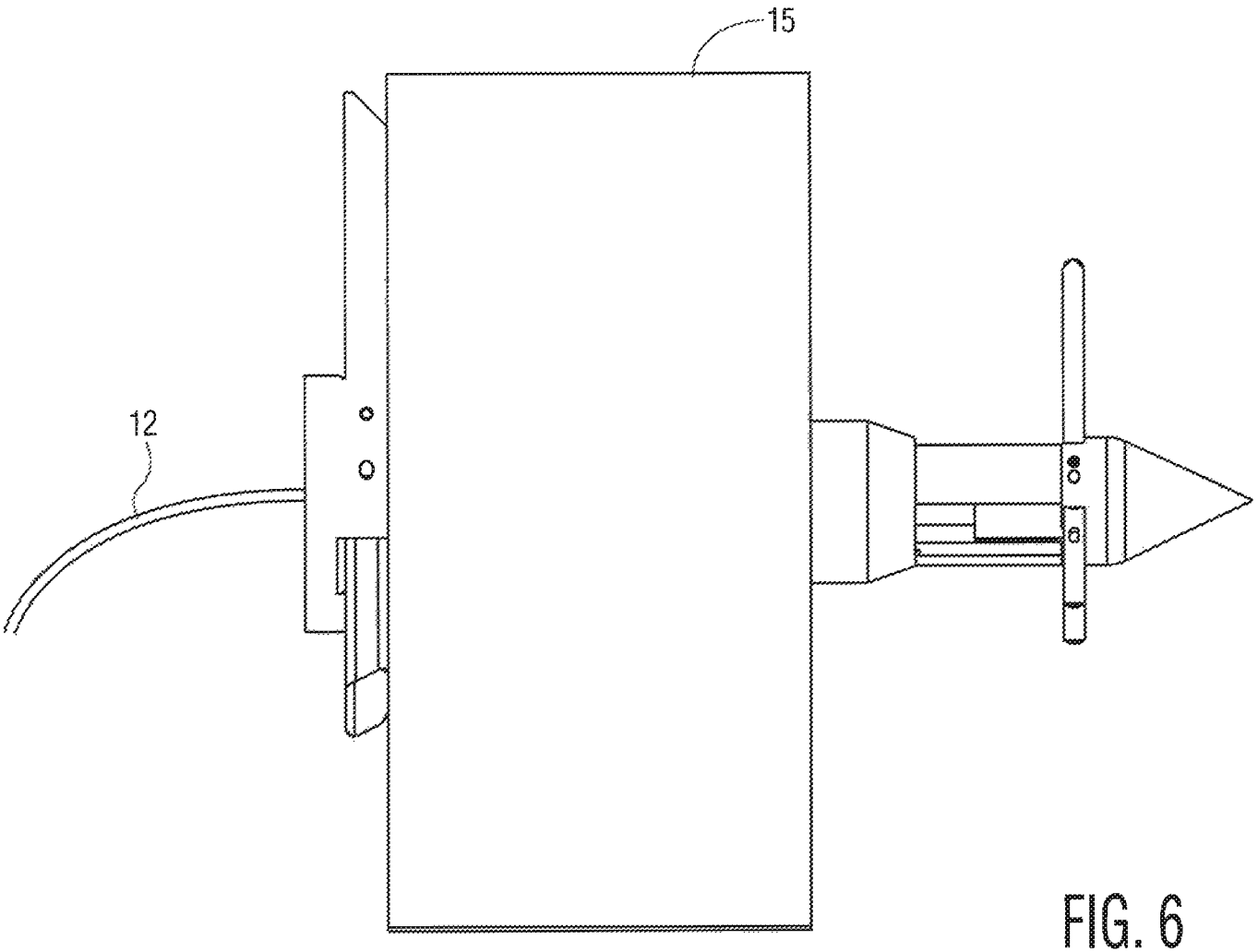

FIG. 6 is a front elevation view of a penetration and retention projectile with an attached tethering line, after penetration of a target 15 stopped by deployed dampening arms 4, and also showing a deployment of retention arms 5, according to this invention.

Figure 7:
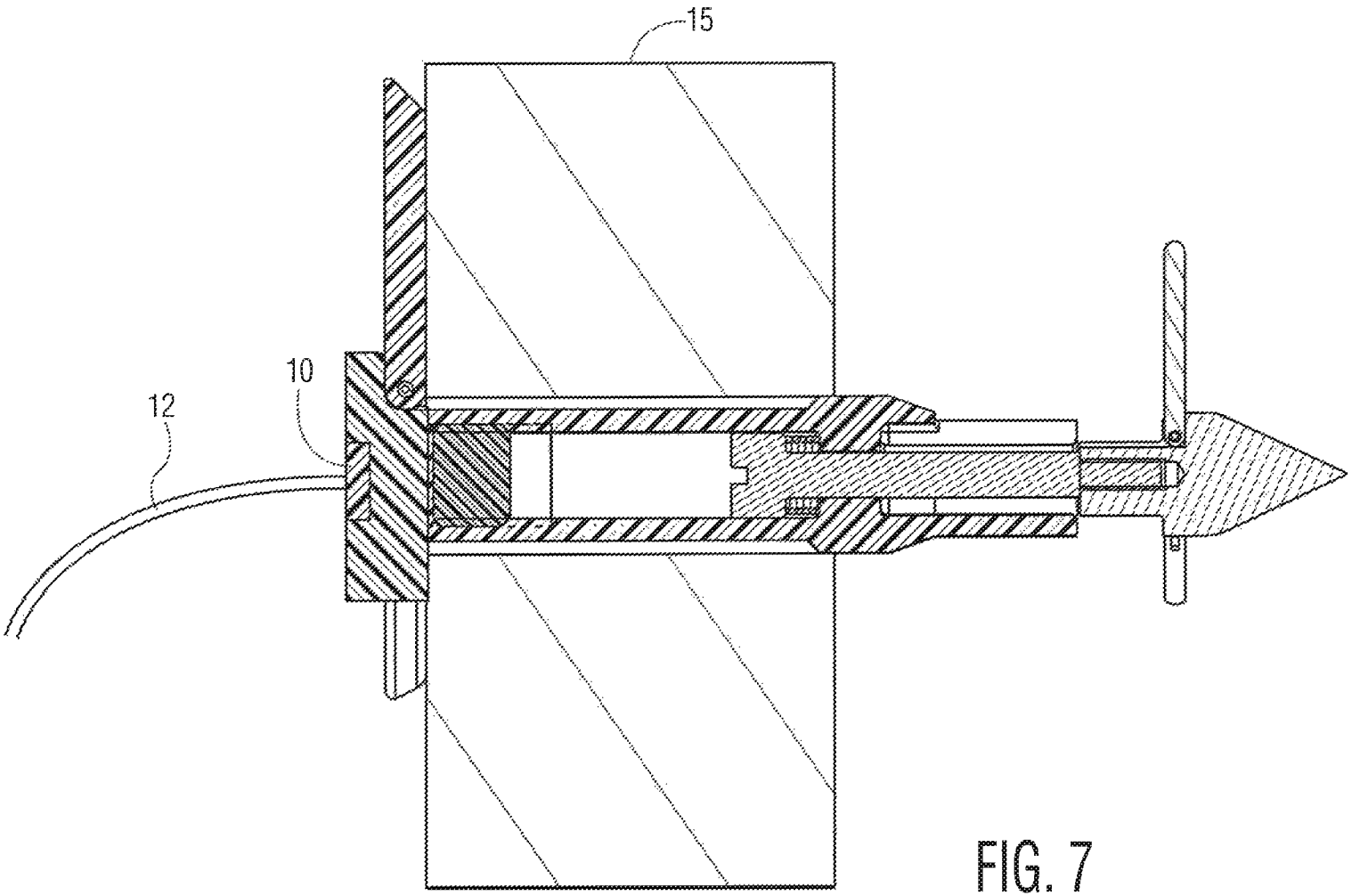

FIG. 7 is a cross sectional view of a penetration and retention projectile with an attached tethering line, after penetration of a target 15 sufficiently to first allow deployment of retention arms 5, according to this invention.

Figure 8:
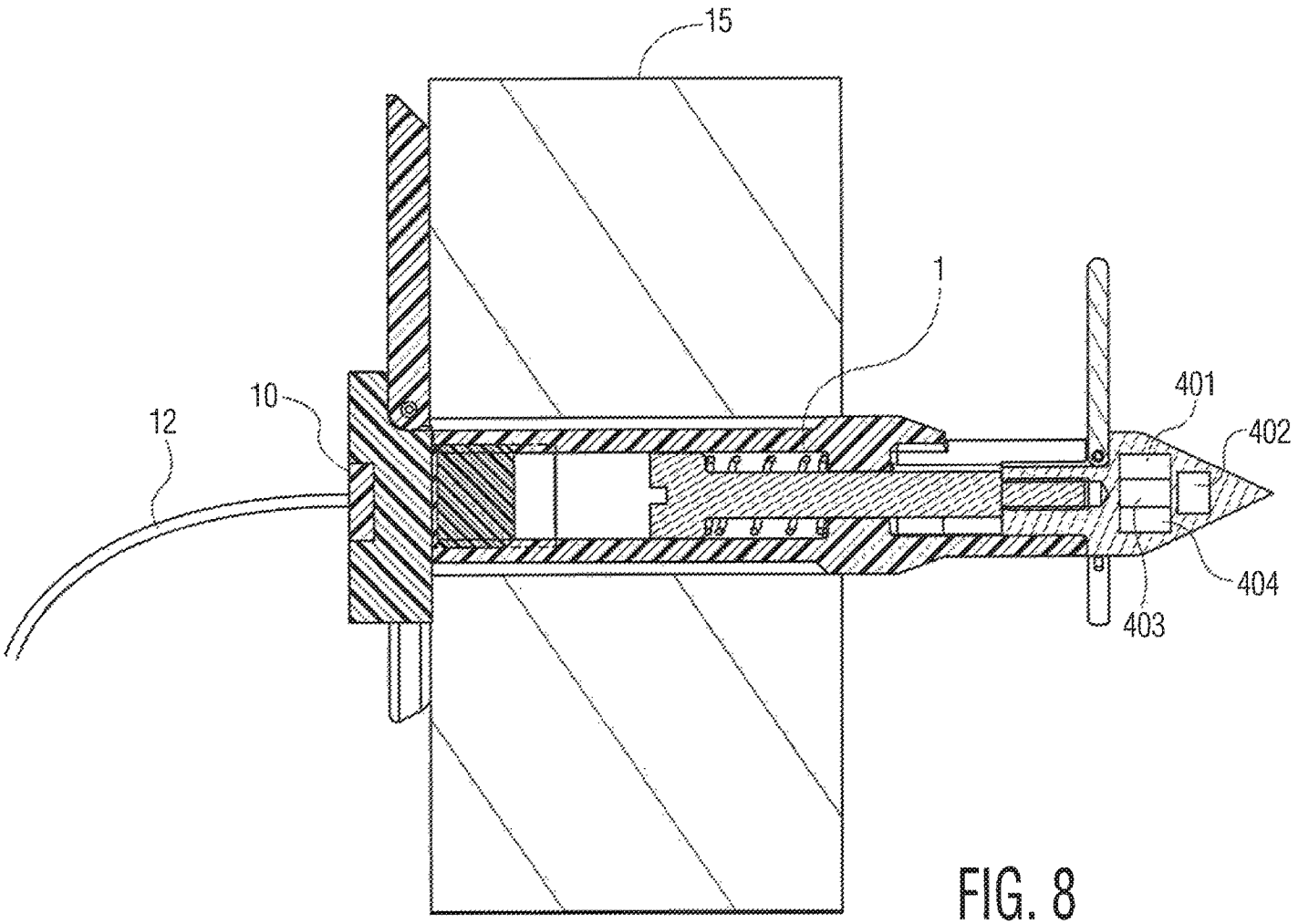

FIG. 8 is a cross sectional view of a penetration and retention projectile of FIG. 7 following penetration of target 15 sufficiently to first allow deployment of retention arms 5, but with spike and deployed retention arms retracted by decompressed spring 1, according to this invention.

Figure 9:
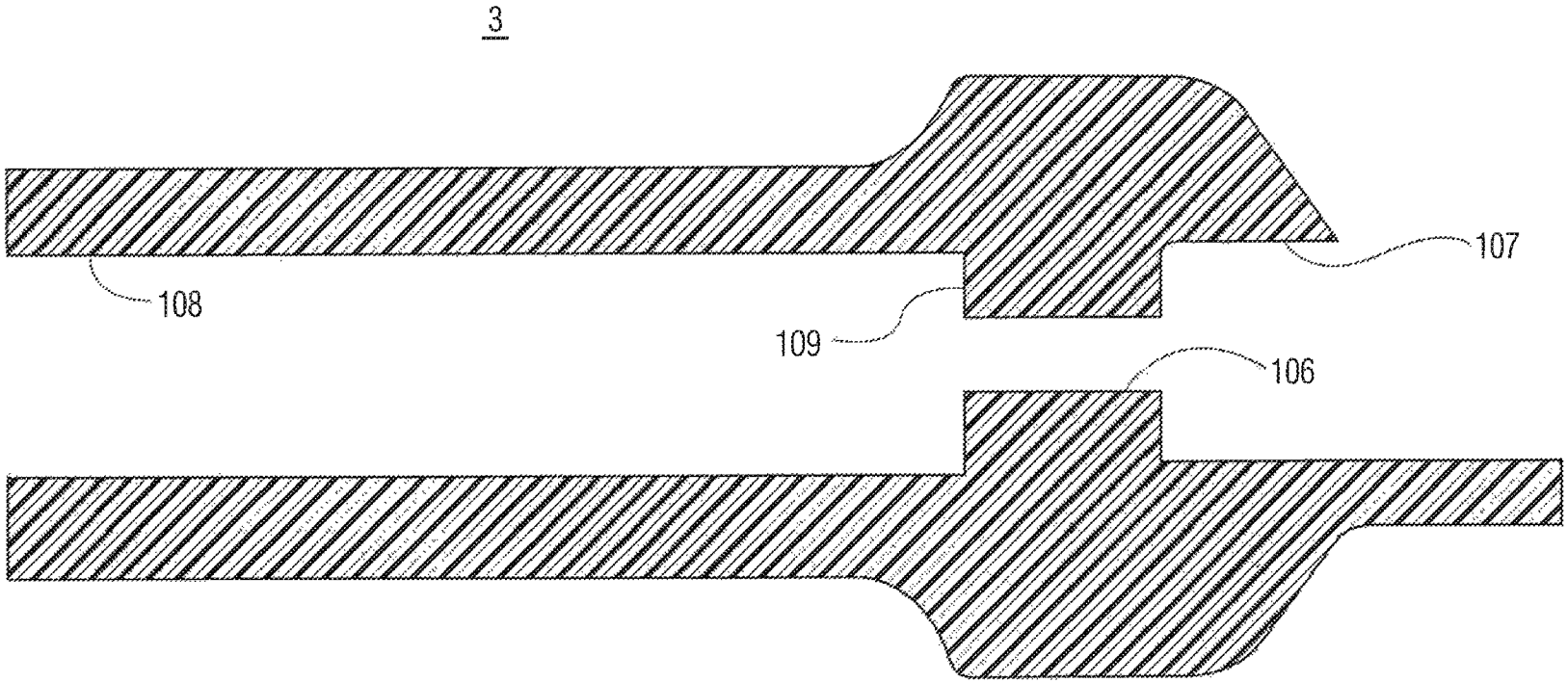

FIG. 9 is an enlarged cross sectional view of plastic body 3.

Figure 10:
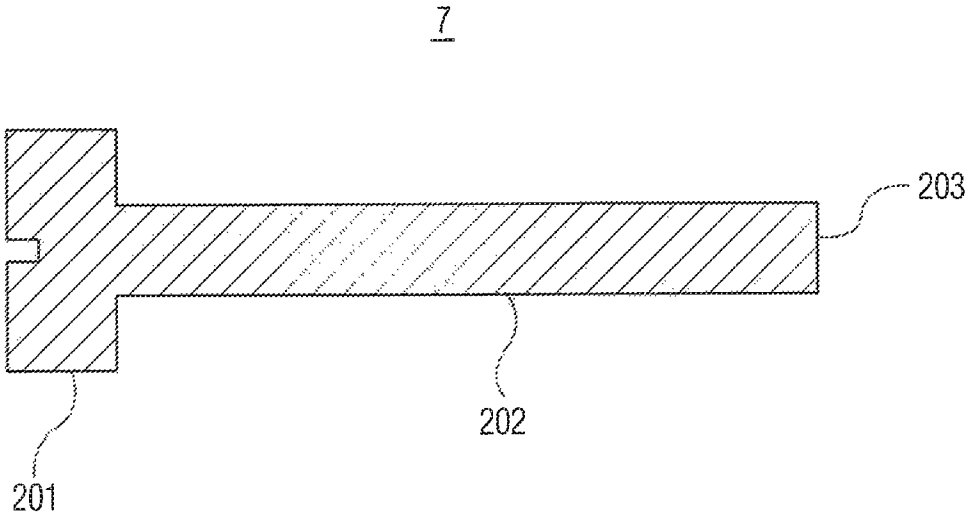

FIG. 10 is an enlarged cross sectional view of threaded rod 7.

Figure 11:
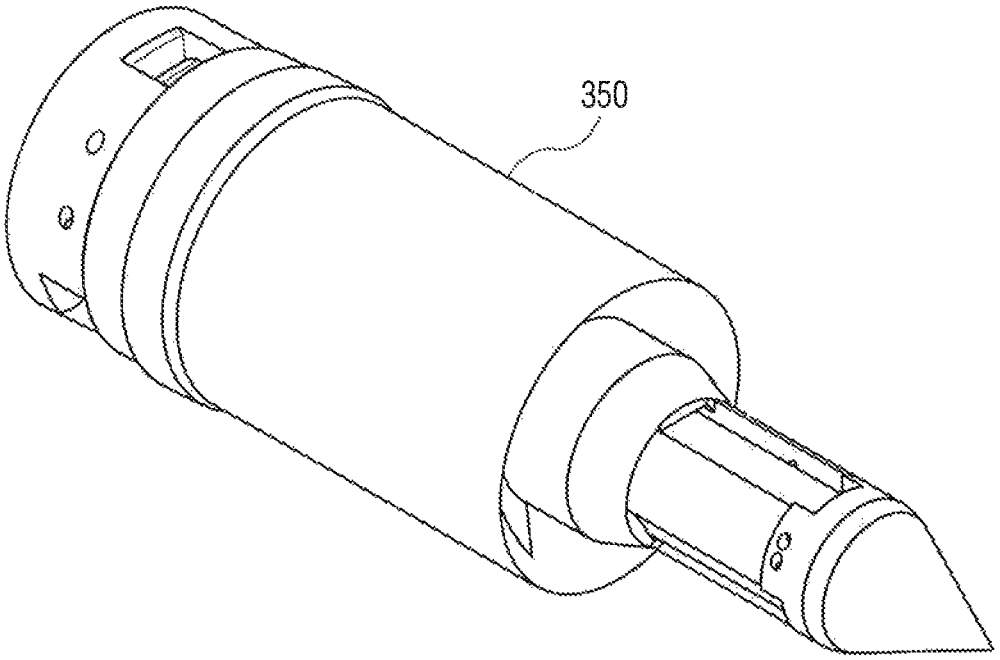

FIG. 11 is a front isometric view of a penetration and retention projectile according to the invention whereby the projectile is covered by an outer sabot device(s) for travel down the bore during a launch.

DETAILED DESCRIPTION

As shown in FIGS. 1-11, the projectile of this invention employs a forward spike 8 initially housed in a plastic body 3 having plastic base 6 with folding plastic dampening arms 4 and folding steel retention arms 5 which collectively act with the forward spike, as explained below. Dampening arms 4 are folded and enclosed within a discarding sabot or sabot(s) 350 (see FIG. 11) for purposes of projectile launching through a gun barrel. Upon exiting the barrel, the sabot(s) 350 begin to release the projectile and discard.

Then, air pressure will cause opening of the rear dampening arms 4, so they will deploy. When the projectile forward spike impacts a target such as 15, the projectile begins to penetrate until the rear dampening arms 4 contact the target's front facing side. This causes the lightweight body of the projectile to stop moving. (Other dampening mechanisms might also be used to stop the round from over penetrating the target, besides the use of a hard stop such as a rear dampening arms hard stop, for example by incorporating springs and other dampening or momentum transfer mechanisms); they can also include a fin which is used to stop the forward momentum of the projectile body, and where the retaining mechanisms of the retention arms may be contained by a spring, dampener, or other mechanical interface, such as a press fit or snap fit or crimp, and which mechanisms are overcome by the impact energy of the body, thereby allowing the retention arms to release from the projectile. After the rear portion of the projectile is stopped by arms 4, the heavy forward section of the projectile including the spike 8 still continues forward due to their momentum, until the threaded rod plunger section 201 (FIG. 10, e.g.) compresses a spring 1 (FIG. 3, e.g.), and thus comes to a hard stop after compressing spring 1 to its limit, and is then blocked by area 109 (FIG. 9) on plastic case 3. As the front section 202 on threaded rod 7 travels forward through hole 106 of plastic case 3, the spring loaded front retention arms 5 are no longer contained within hole 107 of plastic case 3 and the retention arms open up. The opened retention arms now function to retain the targeted object 15 from its other side or rear face. (Alternatively, an O-ring and groove, dampener, or other mechanical feature such as a press fit or snap fit, or other mechanism might be used to retain said retention arms 5 of the front spike section on the round, before the round's impact into the target). As a result, the projectile of this invention is able to attach itself to a target and to retain it on both sides so that it stays with the target. Plastic base 6 is attached to plastic case body 3 through threads on block 16 of the base and the matching threads of the plastic case body 3. A high strength tow line 12 with a drag device for example might be attached to plastic base 6 by a removable attaching means 10 thereon. Thus the targeted UAV, e.g., may now be securely tethered through 12. Possible applications of this invention include adaptations for a harpoon or grappling hook, e.g. In addition to these, the invention can be used as part of a system which incorporates a tow line or drag net to keep a target from escaping or moving freely. Another application of this invention is for the tracking of targets, in which electronics or other features would be incorporated into the body of the projectile of this invention (see FIG. 8, e.g.) to 401 release a signal or a signature indicating locations or other conditions of a captured target, 402 to control the target or the projectile of this invention, 403 to explode or disable a target or the projectile itself, or 404 to release a marking solution or the like, which could then be tracked. Component 1 as mentioned is a compression spring which serves to retain the forward section of the round so that the forward retention arms 5 are contained both during handling and also while in flight within hole 107 of plastic case 3, also along rod 202 of threaded rod 7, and also staying there until any impact. Other dampening elements, or mechanical stops such as a snap fit can be used to retain the forward portion of the round until impact. By so keeping the retention arms 5 housed inside the body (within plastic case 3), the hole produced in the target would be a smaller diameter hole than if the retention arms were in any way opened up. Such smaller hole would allow for a greater probability that the retention arms 5 can retain such target after opening of the arms. Keeping the retention arms 5 inside the body of the projectile until allowing the retention arms to release from being stowed within the projectile also minimizes the likelihood of the retention arms 5 opening before desired even if only accidentally, and is more beneficial from an aerodynamic standpoint. Keeping the retention arms 5 inside of the body of the projectile also minimizes the likelihood of the retention arms being damaged upon impact. It can be seen that problems this invention addresses include how to avoid over penetration of a target while also how to capture a target on both its sides securely, after impact. To date, these problems are not known to have been properly addressed. After the rear portion of the projectile is stopped, the heavy forward section of the projectile continues forward, due to its momentum, until it compresses spring 1 and hits a hard stop. As the front section travels forward, the spring loaded front retention arms 5 are no longer contained and the retention arms 5 open up to retain the object on the object's rear facing side. (Alternatively, an O-ring and groove or other mechanisms can be used to retain the front section of the round with arms 5 before impact). The result is that the projectile is able to attach itself to a target and to retain it on both sides so that it stays with the target. Component 2 is a pin which fastens the retention arms 5 to the forward portion of the projectile. Along with the spring, the pin allows the retention arms to open after penetration. As was mentioned, component 3 serves as a body of the projectile. This part is meant to be light weight, currently plastic, to minimize the energy input to the target on impact, and acts as the main body of the round to which the other parts are attached. As was mentioned, components 4 are the dampening arms which act to stop the forward motion of the round when it impacts the target. These parts 4 are also intended to be lightweight, currently plastic, to minimize the energy input to the target during impact. As was mentioned, the retention arms 5 deploy as the front section moves forward, then opening up so that the projectile is able to capture its target on either side. The retention arms 5 are currently made of steel in order to move the center of gravity of the round forward and to give the front assembly of the round more momentum so that it continues forward after impact. Component 6 is the base of the projectile which is used to attach the dampening arms, and component 6 is threaded so as to attach it to the body 3 of the projectile. The base 6 is also meant to be lightweight, currently plastic, to reduce impact energy. Component 7 is a threaded rod which acts to capture the compression spring, and is attached to the forward spike 8 via threads located in 203 (FIG. 10). Spike 8 is currently made of steel and is intended to cut through the target, creating a clean hole for the rest of the round to follow through during penetration. Retention arms 5 are also attached to the spike as part of the front assembly which drives forward after impact, Spike 8 is intended to be heavy to move the center of gravity forward and to increase the momentum of the front assembly so that it drives forward after impact. Component(s) 9 is a steel pin which is used to attach the dampening arms to the base 6. Alternate materials might also be used for the parts other than those listed. FIG. 11 shows a front isometric view of a penetration and retention projectile according to the invention whereby the projectile is covered by outer sabot device(s) 350 for travel down the bore during launch. (As previously mentioned other dampening devices could be incorporated onto the back of the round, either onto, or instead of the dampening arms to slow the momentum of the round. Also as previously mentioned other dampening or retaining mechanisms might be used to retain the forward section prior to impact and to dampen the impact energy of the round). In addition to this, there are many alternate applications of this technology which are also possible. For example, a projectile which can be used against a manned or unmanned system for the purpose of disabling, retaining, or tracking the system. This projectile may be used to safely disable a UAS or other system in a crowded environment. This projectile may feature a tow line or drag device to control and capture a UAS or other system.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A penetration and retention projectile for use against a target (15), said projectile comprising:

a hollow, cross sectionally circular cylindrical plastic body (3), having an aft end of a first diameter (108) and a narrower diameter (106) in an open through hole at a front stop area (109) of said plastic body, a threaded rod element (6) having an aft area plunger (201) of diameter fitting to the said first diameter of the plastic body but having a frontal area (202) of diameter fitting to said narrower diameter of said plastic body, and wherein said threaded rod element is assembled within said plastic body such that a normally open compression spring (1) is located between said aft area plunger (201) of said threaded rod element and said front stop area (109) of the plastic body, wherein a forward spike element (8) is attached to a frontal area (203) of said threaded rod element, and wherein normally retracted folding steel retention arms (5) having distal edges are attached to the forward spike element through a pin means (2), and said retention arms are normally folded so the distal edges thereon are captured in a third diameter hole (107) at the front of said plastic body while said retention arms overlay said forward spike element before and during a launch scenario of said projectile, and a flat, cross sectionally rectangular shaped, plastic base (6) which is attached with the aid of a block (16) in a flush manner at the aft end of said plastic body (3), and a plurality of normally folded, folding plastic dampening arms (4) attached at edges of said plastic base through steel pins (9), said dampening arms being functional to open during a launch scenario to deploy, and wherein during a launch scenario, dampening arms (4) deploy, and next said projectile also completely pierces through a target (15), and wherein, said projectile forward motion is abruptly halted when the deployed dampening arms become flush with a forward face of the target, which abrupt halting action causes complete compression of the spring (1) by the aft area plunger (201) of the threaded rod (7), and wherein such compression of the spring in turn allows forward spike element (8) with its attached steel retention arms (5) to advance sufficiently so that the retention arms distal edges are no longer captured within third diameter hole (107) of the plastic body, which further in turn allows the retention arms to fly open through inertia and deploy, and wherein the opened said retention arms then serve to capture the target (15) at a rear face on said target such that the projectile cannot thereafter be dislodged from said target.

2. The penetration and retention projectile of claim 1 wherein said dampening arms (4) are covered by a sabot means (350) while initially fired down a barrel, but said sabot means discard in flight during a launch scenario.

3. The penetration and retention projectile of claim 1 wherein said plastic base (6) has a tether (12) connected thereto through a detachable connecting means (10), said tether means for remotely holding onto said projectile through its said base.

4. The penetration and retention projectile of claim 2 wherein the projectile is used to safely disable a UAS or other system in a crowded environment.

* * * * *